US008100118B2

(12) United States Patent
Sudmanns

(10) Patent No.: US 8,100,118 B2
(45) Date of Patent: Jan. 24, 2012

(54) EXHAUST GAS VALVE

(75) Inventor: Hans Sudmanns, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 372 days.

(21) Appl. No.: 12/175,830

(22) Filed: Jul. 18, 2008

(65) Prior Publication Data

US 2009/0056317 A1 Mar. 5, 2009

(30) Foreign Application Priority Data

Jul. 19, 2007 (DE) ..... 10 2007 033 679

(51) Int. Cl.
*F02B 47/08* (2006.01)
*F02B 47/04* (2006.01)

(52) U.S. Cl. ..... 123/568.17; 123/568.18

(58) Field of Classification Search ..... 123/568.17, 123/568.12, 568.18, 568.11; 285/129.2, 285/148.8, 148.25, 148.4; 60/605.2, 288
See application file for complete search history.

(56) References Cited

U.S. PATENT DOCUMENTS

| | | | | |
|---|---|---|---|---|
| 6,050,614 | A * | 4/2000 | Kirkpatrick | 285/368 |
| 6,186,115 | B1 * | 2/2001 | Nishimura et al. | 123/337 |
| 6,213,105 | B1 * | 4/2001 | Banzhaf et al. | 123/568.12 |
| 6,308,666 | B1 | 10/2001 | Drecq et al. | |
| 6,328,281 | B1 * | 12/2001 | Jung | 251/305 |
| 6,360,532 | B2 * | 3/2002 | Strahle et al. | 60/321 |
| 6,968,832 | B1 * | 11/2005 | Rowells | 123/568.11 |
| 7,107,761 | B2 * | 9/2006 | Fukuma et al. | 60/285 |
| 7,299,793 | B1 * | 11/2007 | Tyo et al. | 123/568.12 |
| 7,353,102 | B2 * | 4/2008 | Narita et al. | 701/102 |
| 2005/0247294 | A1 | 11/2005 | Rowells | |

FOREIGN PATENT DOCUMENTS

| | | |
|---|---|---|
| DE | 197 50 588 A1 | 5/1999 |
| DE | 203 18 321 U1 | 4/2004 |
| DE | 103 51 845 B4 | 6/2005 |
| DE | 10 2005 033 023 A1 | 1/2007 |

* cited by examiner

*Primary Examiner* — Mahmoud Gimie
(74) *Attorney, Agent, or Firm* — Bill C. Panagos; Rader, Fishman & Grauer PLLC

(57) ABSTRACT

The invention relates to an exhaust gas line for exhaust gas from at least one cylinder of an internal combustion engine, having at least one collecting housing (1) with a connection to an exhaust gas recirculation system (2). The collecting housing (1) is designed as a section of the exhaust gas line for the internal combustion engine.

19 Claims, 9 Drawing Sheets

EXHAUST GAS VALVE

CROSS REFERENCE TO RELATED APPLICATIONS

This application is a National Phase Application related to DE 2007 033 679.0 which was filed on Jul. 19, 2007 which application is incorporated herein by reference in its entirety.

TECHNICAL FIELD

This disclosure relates to an exhaust gas line for an internal combustion engine.

BACKGROUND

DE 10 2005 033 023 A1 discloses a heat exchanger device and a method for operating this heat exchanger device in a vehicle having an internal combustion engine, wherein an oil cooler and an exhaust gas recirculation cooler are integrated into the heat exchanger system, a cooling medium passing through the heat exchanger system, and heat flow being exchanged between oil, exhaust gas, and/or cooling medium, and are controlled as a function of operating states of the internal combustion engine in order to optimize emission of pollutants and fuel consumption.

A device is known from DE 197 50 588 for exhaust gas recirculation for an internal combustion engine, having an exhaust gas cooler and a valve which determines the quantity of exhaust gas recirculated and which is adjustable by means of an actuator, the exhaust gas cooler and the valve directly adjoining one another and forming a modular unit.

DE 103 51 845 B4 discloses an exhaust gas heat exchanger for cooling exhaust gas from an internal combustion engine, using a two-stage exhaust gas recirculation system. The cooling system has a high-temperature branch with coolant at a high temperature level, and has a low-temperature branch with coolant at a temperature lower than that of the coolant in the high-temperature branch. A high-temperature exhaust gas heat exchanger is provided in the high-temperature branch, and a low-temperature exhaust gas heat exchanger is provided in the low-temperature branch, and exhaust gas to be recooled passes through both in succession. Such an exhaust gas heat exchanger is described as being economical and space-saving, with optimal cooling of the exhaust gas.

The object of the present invention is to provide an exhaust gas line for an internal combustion engine by means of which an overall design for the exhaust gas recirculation system for a model series of internal combustion engines having different power ratings, and with different numbers of cylinders, is achieved for all applications, and for cooled and uncooled exhaust gas lines, with a minimum number of part variations for the exhaust gas recirculation system.

This object is achieved by use of an exhaust gas line for an internal combustion engine having the features of claim 1. Advantageous embodiments of the invention are stated in the subclaims.

According to the invention, an exhaust gas line for exhaust gas from at least one cylinder of an internal combustion engine has at least one collecting housing from which an exhaust gas recirculation system branches off. According to the invention, the collecting housing is designed as a section of the exhaust gas line for the internal combustion engine, with the advantage that, on account of integrating the collecting housing and exhaust gas line, the number of components for the exhaust gas line for a model series of the internal combustion engine having exhaust gas recirculation may be minimized for different power ratings and for different numbers of cylinders, and for all applications, resulting in cost and logistical advantages for the exhaust gas recirculation system with minimal modification effort for existing designs, and a minimal number of part variations.

According to one preferred embodiment of the invention, the collecting housing has an exhaust gas inlet which is designed as a flange for an exhaust gas outlet for the internal combustion engine.

According to a further preferred embodiment of the invention, the internal combustion engine has multiple cylinders in a V-shaped configuration, and the exhaust gas outlet for the internal combustion engine is situated between the cylinder heads, so that the collecting housing together with the integrated exhaust gas line and a respective branch to an exhaust gas recirculation system are advantageously located between the cylinder rows of an eight-cylinder V-8 internal combustion engine, for example, for an overall space-saving design.

According to a further preferred embodiment of the invention, each flange, which is rotatable by 180°, is provided between the collecting housing and an exhaust gas outlet on outwardly facing sides of the cylinder heads, so that by rotating the collecting housing relative to the cylinder head the position of the collecting housing together with the integrated exhaust gas line and a respective branch to an exhaust gas recirculation system may be specified in a flexible manner which is the most advantageous for an overall space-saving configuration.

According to a further preferred embodiment of the invention, the collecting housing has an additional connection for recirculated exhaust gas to an air intake for the internal combustion engine.

According to a further preferred embodiment of the invention, the collecting housings integrated into the exhaust gas line are provided with lateral surfaces which are at least partially congruent so that collecting housings may be installed in succession, thereby allowing the number of branches to exhaust gas recirculation systems to be varied as needed.

According to a further preferred embodiment of the invention, the width of a collecting housing corresponds to the width of a cylinder of the internal combustion engine, thus allowing the collecting housing to be positioned in parallel with cylinders of the internal combustion engine.

According to a further preferred embodiment of the invention, the exhaust gas recirculation system is provided with a deflector housing for compact recirculation of the exhaust gas.

According to a further preferred embodiment of the invention, the exhaust gas recirculation system is provided with heat exchangers for cooling recirculated exhaust gas, thereby optimizing emission of pollutants and fuel consumption of the internal combustion engine. According to a further preferred embodiment of the invention, the collecting housing and deflector housing are integrated into the cooling system in order to reduce thermal stress.

According to a further preferred embodiment of the invention, the heat exchangers, in particular three heat exchangers, are connected in series for increased thermal output.

According to a further preferred embodiment of the invention, the heat exchangers, in particular three heat exchangers, are connected in parallel in order to minimize pressure losses and to provide uniform load on the heat exchangers.

According to a further preferred embodiment of the invention, two heat exchangers are connected in parallel and one heat exchanger is connected thereto in series, resulting in an optimal compromise regarding thermal output, pressure losses, and stress on the heat exchangers.

According to a further preferred embodiment of the invention, the collecting housing is provided with an exhaust gas recirculation butterfly valve which is connected directly to the exhaust gas heat exchanger and is provided between the cylindrical chamber of the collecting housing and the exhaust gas line to the turbine of the turbocharger, in an essentially cylindrical exhaust gas recirculation duct in the form of a centrally pivotable switching valve.

According to a further preferred embodiment of the invention, an inner cross section of the exhaust gas line is provided with profiles with tapering cross sections in order to produce a linearized flow characteristic curve for the exhaust gas.

According to a further preferred embodiment of the invention, the profiles with tapering cross sections are patterned as circular segments whose respective midpoints lie outside the center of rotation of the switching valve, and whose radii are larger than the switching valve.

According to a further preferred embodiment of the invention, the exhaust gas recirculation butterfly valve is designed as a switching valve or a rotary valve, and is mechanically connected to a controller which is preferably actuated by compressed air.

According to a further preferred embodiment of the invention, leak discharge outlets are provided in the deflector housing to avoid backflow of leaking fluid to the cylinders of the internal combustion engine.

BRIEF DESCRIPTION OF THE DRAWINGS

The invention is explained below with reference to a preferred exemplary embodiment. The drawings show the following.

DETAILED DESCRIPTION

Figure 1:
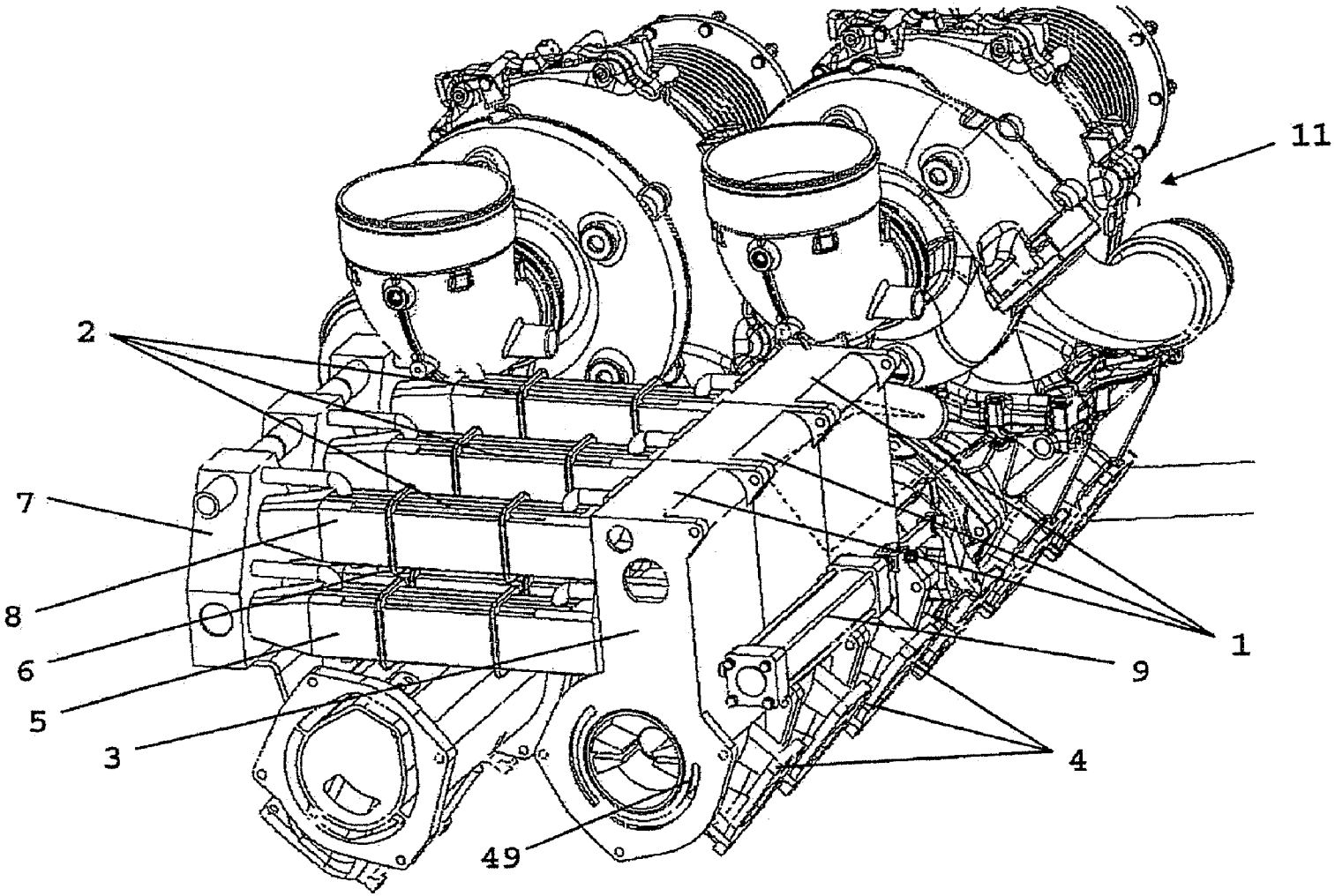
FIG. 1 shows a perspective view of an internal combustion engine having an exhaust gas line through a collecting housing, and exhaust gas recirculation systems having heat exchangers according to the invention.

FIG. 1, 9: Three metallic collecting housings 1 together with an integrated exhaust gas line and a respective branch to an exhaust gas recirculation system 2 are situated between the cylinder rows 51, 52 of an eight-cylinder V-8 internal combustion engine 50. The collecting housings 1 are flanged together at their coplanar and congruent lateral surfaces 3 in a gas- and liquid-tight manner. The connection of the collecting housing 1 to associated cylinders of the internal combustion engine is established in each case by a flange 4 for an exhaust gas outlet of the internal combustion engine 50. The width of a collecting housing 1 corresponds to the width of a cylinder of the internal combustion engine 50.

The exhaust gas recirculation system 2 is formed by the collecting housings 1 via two heat exchangers 5, 6 connected in parallel, a deflector housing 7, and a heat exchanger 8 connected in series for two-stage cooling of recirculated exhaust gas. A pneumatic actuating cylinder 9 mechanically connected to an exhaust gas recirculation butterfly valve (see FIG. 5, 6) controls the proportion of exhaust gasses that flow from the collecting housing 1 directly through the exhaust gas line to a turbine of a turbocharger 11 or into the exhaust gas recirculation system 2.

An eight-cylinder V-8 internal combustion engine 50 has cylinder rows 51, 52 containing cylinder heads 53, 54. The collecting housings 1 are respectively mounted above flanges 4, which are rotatable by 180°, at the external exhaust gas outlets for the internal combustion engine 50. The collecting housings 1 are connected to two heat exchangers 5, 6 connected in parallel, and to a deflector housing 7. The collecting housings 1 are rotatable relative to the cylinder heads 53, 54 in space-saving positions.

Figure 2:
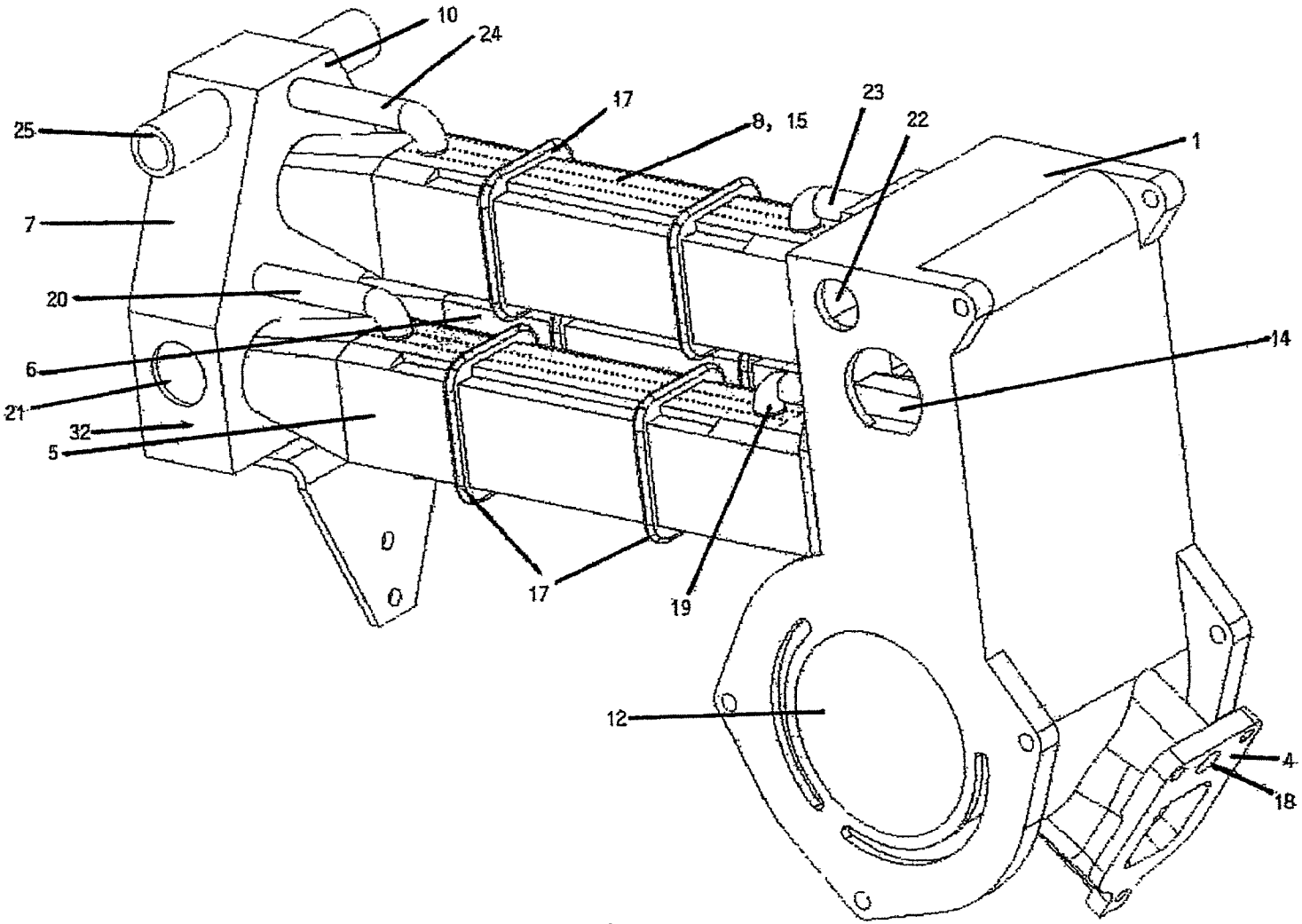
FIG. 2 shows a perspective view of an exhaust gas line for an internal combustion engine, together with a collecting housing for an exhaust gas recirculation system having heat exchangers according to the invention.
Figure 3:
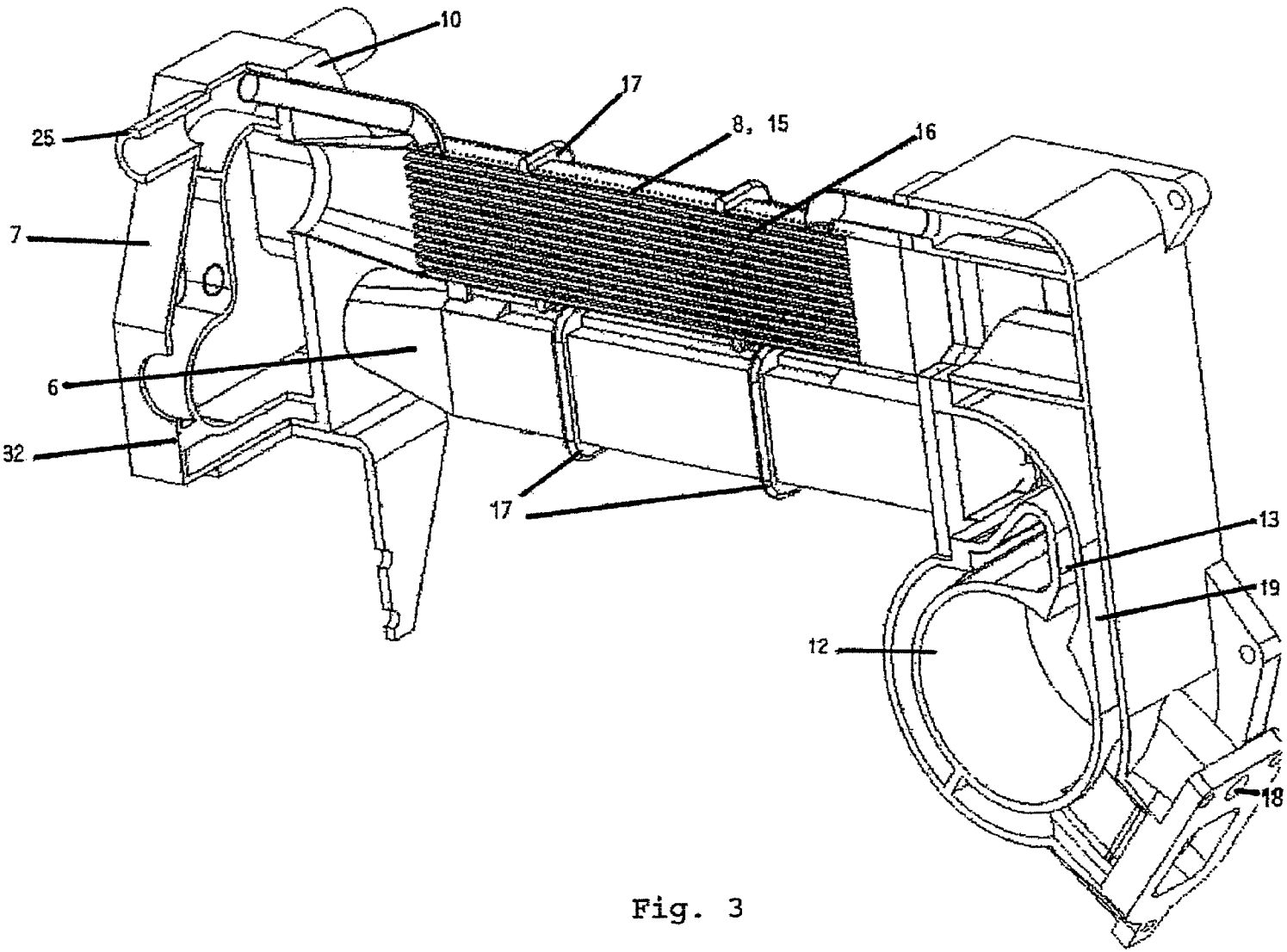
FIG. 3 shows a perspective view of a partially cutaway exhaust gas line according to FIG. 1.

FIG. 2, 3: Corresponding features are denoted by the same reference numerals used in the preceding figure. In its lower region the collecting housing 1 has a cylindrical chamber 12 which is designed as part of the exhaust gas line, and from which a duct 13 branches off to the exhaust gas recirculation system 2.

The exhaust gas recirculation system 2 is connected to the collecting housing 1 at a high-temperature branch having two heat exchangers 5, 6 which are connected in parallel and which open into a rear wall 10 of the deflector housing 7, from which a low-temperature branch having the heat exchanger 8 connected in series returns the exhaust gas to the collecting housing 1. Cooled, recirculated exhaust gas flows from the collecting housing 1, through a disposal opening 14, and back into the internal combustion engine 50.

Heat exchangers 5, 6, and 7 each comprise a housing 15 and exhaust gas ducts 16 situated in the housing 15 which are formed from tubes. The housings 15 for heat exchangers 5, 6, and 8 are cross-sectionally reinforced at their periphery by means of bars 17.

The two heat exchangers 5, 6 of the high-temperature branch which are connected in parallel are each acted on by high-temperature coolant from the cylinder via a feed line 18 and a line 19, the high-temperature coolant being conveyed via a respective outlet 20 and an opening 21 in the deflector housing 7. Coolant flows in co-current flow with the exhaust gas through the heat exchangers 5, 6 in the high-temperature branch in order to minimize thermal stress. Coolant having a temperature lower than that of the high-temperature coolant is fed to the collecting housing 1 via a supply bore 22, and via line 23 is fed to the heat exchanger 8 in the low-temperature branch, so that for maximum heat exchange the coolant flows counter to the exhaust gas via line 24 into the deflector housing 7, and then via discharge line 25 is conveyed into the circuit for the low-temperature coolant.

Figure 4:
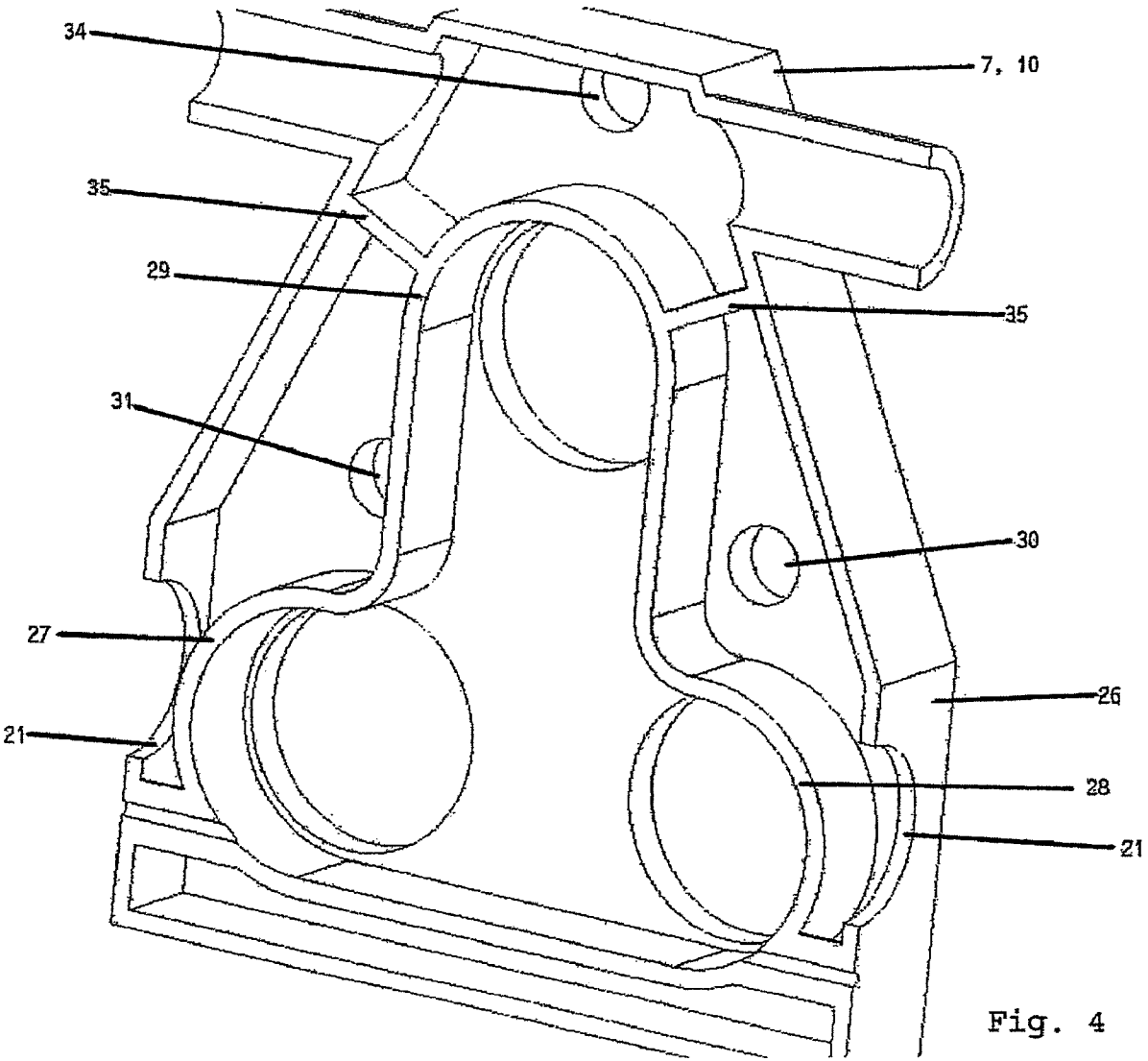
FIG. 4 shows a perspective view of a cross section of a deflector housing for an exhaust gas recirculation system having heat exchangers according to the invention.

FIG. 4: Corresponding features are denoted by the same reference numerals used in the preceding figures. The deflector housing 7 has a base 26 with an essentially rectangular cross section, from which the deflector housing 7 proceeds upwardly in an essentially truncated cone shape. The width of the base 26 of the deflector housing 7 corresponds to the width of the collecting housing 1.

The rear wall 30 of the deflector housing 7 has two receptacles 27, 28 for holding the heat exchangers 5, 6 in the high-temperature branch, and a receptacle 29 centrally located thereabove for the heat exchanger 8 in the low-temperature branch. High-temperature coolant flows from the heat exchangers 5, 6 through front openings 30, 31 and into the deflector housing 7, and flows on both sides through the openings 21 in the base 26 in/out of the deflector housing 7 into the circuit for the high-temperature coolant. Low-temperature coolant flows through a front opening 34 in the truncated cone, into the deflector housing 7, and into the circuit for the low-temperature coolant. The low-temperature coolant regions in the deflector housing 7 are separated from the high-temperature coolant regions by means of bars 35. On each side of the base 26 a leak discharge outlet 32 (see FIG. 2, 3) is provided in the deflector housing 7, below the openings 21 for the high-temperature coolant.

Figure 5:
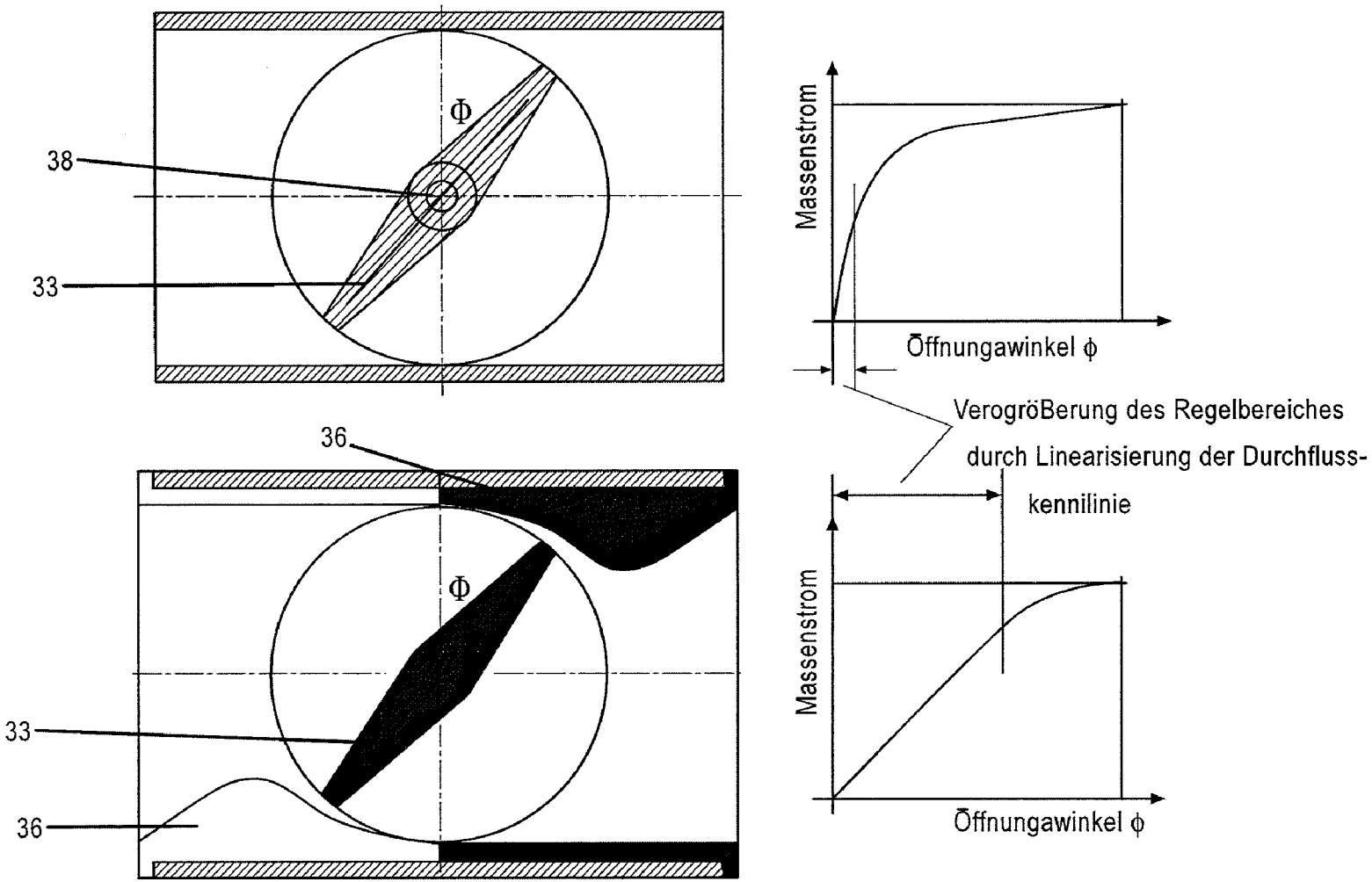
FIG. 5 shows cross sections of a switching valve in an exhaust gas recirculation duct according to the invention, compared to a switching valve in an exhaust gas recirculation duct according to the prior art.

FIG. 5: Corresponding features are denoted by the same reference numerals used in the preceding figures. Between the cylindrical chamber 12 of the collecting housing 1 and the turbine of the turbocharger 11 a centrally pivotable switching valve 33 is provided in an essentially cylindrical exhaust gas recirculation duct, and controls an inner cross section of the exhaust gas line 2 having profiles 36 with tapering cross sections in order to produce a linearized flow characteristic curve for the exhaust gas, whereby the profiles 36 with tapering cross sections, compared to an exhaust gas recirculation duct of the prior art illustrated thereabove which does not have profiles with tapering cross sections, result in an enlargement of the control region, which in the starting region of the opening in the centrally pivotable switching valve 33 results in a much slower and more uniform increase in flow with increasing opening angle, resulting in improved adjustability of this flow, as illustrated in the adjacent diagrams. The profiles 36 with tapering cross sections are patterned as circular segments whose respective midpoints lie outside the center of rotation of the switching valve 33, and whose radii are larger than the switching valve 33. The switching valve 33 is controlled by the actuating cylinder 9 via a shaft 38 which supports the switching valve 33 in the exhaust gas line.

Figure 6:
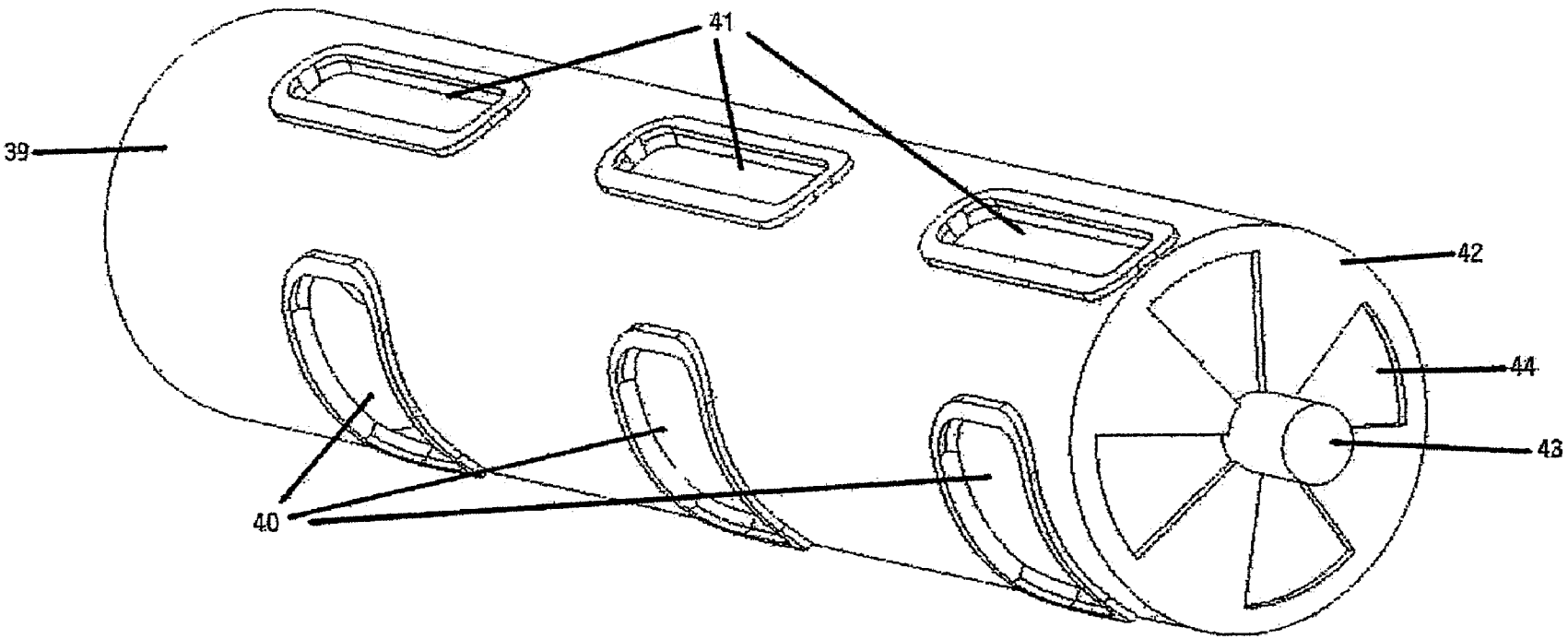
FIG. 6 shows a perspective view of an exhaust gas recirculation butterfly valve according to the invention, designed as a rotary valve.

FIG. 6: Corresponding features are denoted by the same reference numerals used in the preceding figure. In the cylindrical chamber 12 of the collecting housing 1, an exhaust gas recirculation butterfly valve in the form of an essentially cylindrical rotary valve 39 having exhaust gas inlet and outlet openings 40, 41 is rotatably supported with an exact fit. Regardless of the rotational position of the rotary valve 39, the exhaust gas inlet openings 40 are always open for the passage of exhaust gas from the cylinders of the internal combustion engine, through the flange 4, and into the cylindrical chamber 12 of the collecting housing 1, whereas the free cross section of the outlet openings 41 is controlled by the actuating cylinder 9 by rotating the rotary valve 39 relative to the collecting housing 1 for the passage of exhaust gas from the cylindrical chamber 12 into the duct 13 for exhaust gas recirculation, and a fanned passage 44 which is adjustable about a central shaft 43 is provided on the end face 42 of the rotary valve 39, and closes off the passage of exhaust gas from the cylindrical chamber 12 into the exhaust gas line to the extent by which the outlet openings 41 are opened to the duct 13 for the exhaust gas recirculation system 2.

Figure 7:
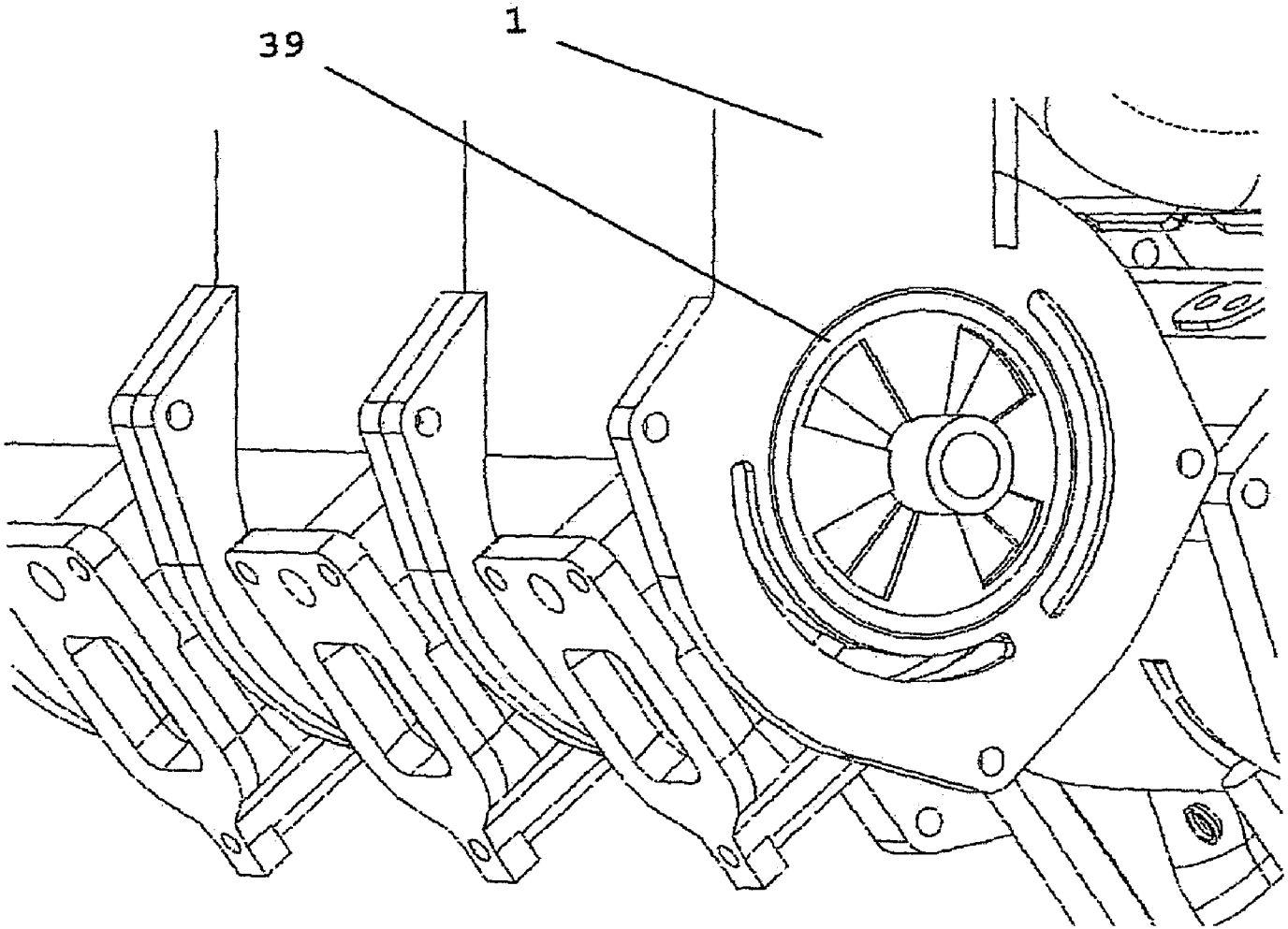
FIG. 7 shows a perspective view of a rotary valve according to the invention installed in a collecting housing.

FIG. 7 shows a rotary valve 39, mounted in a collecting housing 1, in a rotary position for partial exhaust gas recirculation.

Figure 8:
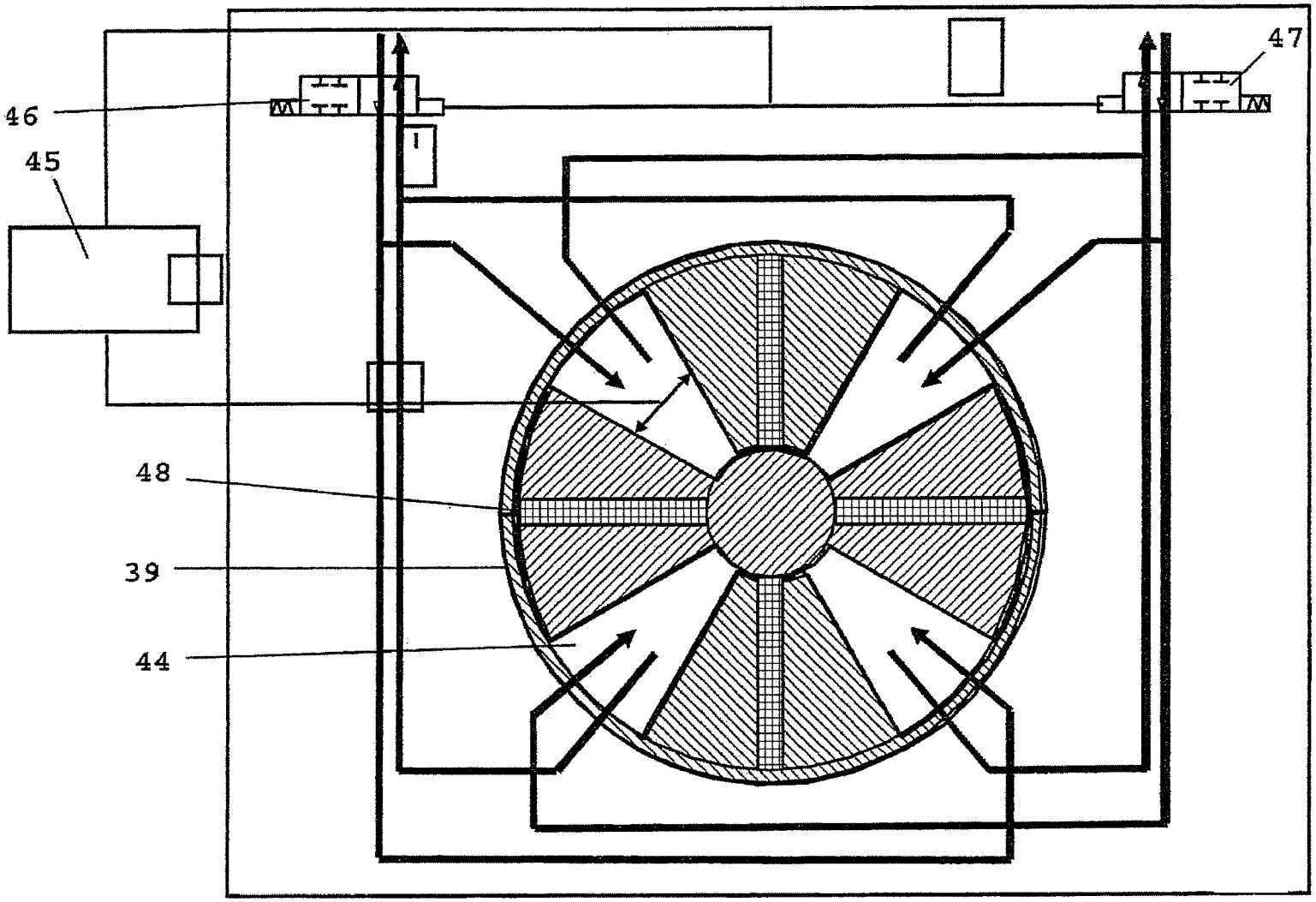
FIG. 8 shows a schematic illustration of a control system for a rotary valve according to the invention.
Figure 9:
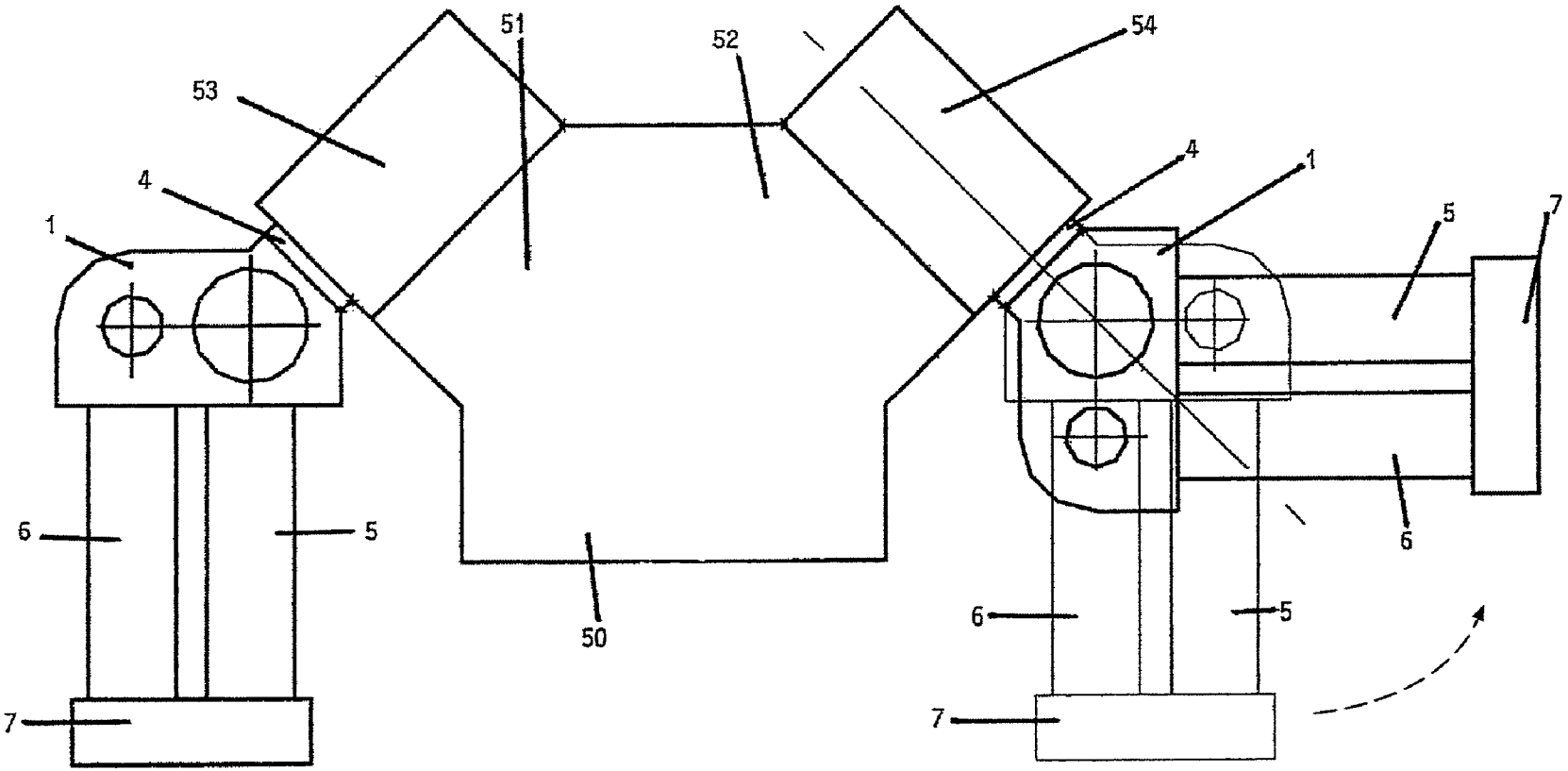
FIG. 9 shows a schematic illustration of an internal combustion engine having an external collecting housing, together with an exhaust gas line, exhaust gas recirculation systems, and heat exchangers according to the invention.

FIG. 8: Corresponding features are denoted by the same reference numerals used in the preceding figure. A controller 45 drives electrically driven 2/2 timing valves 46, 47 which are able to rotate an actuator 48 for the rotary valve 39 to the left or right for adjusting the fanned passage 44 for exhaust gas from the cylindrical chamber 12 into the exhaust gas line, the control being performed as a function of measured values which the controller 45 receives from path measurements at the fanned passage 44. A cover 49 (see FIG. 1) is mounted on the actuator 48, and, together with the actuator 48 and the end face 42 of the rotary valve 39, forms a pressure chamber. Boreholes (not illustrated) are provided in the cover 49 to and from the electrically driven timing valves 46, 47.

The invention claimed is:

1. An exhaust gas line for exhaust gas from more than one cylinder of an internal combustion engine, the exhaust gas line having a plurality of collecting housings with a connection to an Exhaust Gas Recirculation (EGR) system, wherein each collecting housing includes a flange to integrate the collecting housing with the exhaust gas line of the engine, the collecting housings also being a part of the EGR system via the flange, wherein at least two of said collecting housings are arranged in series in a parallel configuration and are joined together at coplanar surfaces and each collecting housing is associated with one cylinder.

2. The exhaust gas line according to claim 1, wherein the internal combustion engine has multiple cylinders in a V-shaped configuration, and the exhaust gas outlet for the internal combustion engine is between the cylinder heads.

3. The exhaust gas line according to claim 1, wherein the collecting housing is provided with lateral surfaces which are at least partially congruent.

4. The exhaust gas line according to claim 1, wherein the width of the collecting housing corresponds to the width of a cylinder of the internal combustion engine.

5. The exhaust gas line according to claim 1, wherein the collecting housing includes an exhaust gas recirculation butterfly valve.

6. The exhaust gas line according to claim 5, wherein the exhaust gas recirculation butterfly valve is a switching valve.

7. The exhaust gas line according to claim 5, wherein the exhaust gas recirculation butterfly valve is connected directly to the exhaust gas heat exchanger and is between the cylindrical chamber of the collecting housing and the turbine of the turbocharger, in an essentially cylindrical exhaust gas recirculation duct in the form of a centrally pivotable switching valve.

8. The exhaust gas line according to claim 5, wherein an inner cross section of the exhaust gas line includes profiles with tapering cross sections.

9. The exhaust gas line according to claim 8, wherein the profiles with tapering cross sections are patterned as circular segments whose respective midpoints lie outside a center of rotation of the switching valve, and whose radii are larger than the switching valve.

10. The exhaust gas line according to claim 5, wherein the exhaust gas recirculation butterfly valve is a rotary valve.

11. The exhaust gas line according to claim 5, wherein the exhaust gas recirculation butterfly valve is mechanically connected to a pneumatically actuated controller.

12. An exhaust gas line for exhaust gas from more than one cylinder of an internal combustion engine, the exhaust gas line having at least one collecting housing with a connection to an Exhaust Gas Recirculation (EGR) system, wherein the collecting housing comprises a part of the exhaust gas line of the engine and also is a part of the EGR system, at least two of said collecting housings are arranged in series and each collecting housing is associated with one cylinder;

wherein the collecting housing has an additional connection for recirculated exhaust gas to an air intake for the internal combustion engine.

13. An exhaust gas line for exhaust gas from more than one cylinder of an internal combustion engine, the exhaust gas line having at least one collecting housing with a connection to an Exhaust Gas Recirculation (EGR) system, wherein the collecting housing comprises a part of the exhaust gas line of the engine and also is a part of the EGR system, at least two of said collecting housings are arranged in series and each collecting housing is associated with one cylinder;

wherein each exhaust gas recirculation system is provided with one deflector housing.

14. The exhaust gas line according to claim 13, wherein leak discharge outlets are in the deflector housing.

15. An exhaust gas line for exhaust gas from more than one cylinder of an internal combustion engine, the exhaust gas line having at least one collecting housing with a connection to an Exhaust Gas Recirculation (EGR) system, wherein the collecting housing comprises a part of the exhaust gas line of the engine and also is a part of the EGR system, at least two of said collecting housings are arranged in series and each collecting housing is associated with one cylinder;

wherein the exhaust gas recirculation system is provided with heat exchangers which are preferably acted on by coolant for cooling recirculated exhaust gas; and wherein coolant flows through the collecting housing and the deflector housing.

16. The exhaust gas line according to claim 10, wherein the heat exchangers, in particular three heat exchangers, are connected in series.

17. The exhaust gas line according to claim 10, wherein the heat exchangers, in particular three heat exchangers, are connected in parallel.

18. The exhaust gas line according to claim 10, wherein two heat exchangers are connected in parallel and one heat exchanger is connected thereto in series.

19. An exhaust gas line for exhaust gas from a plurality of cylinders, each cylinder having a head, comprising:

a plurality of collecting housings joined together and arranged in a parallel configuration in a series with each collecting housing having a connection to an exhaust gas recirculation system, wherein each collecting housing comprises a section of the exhaust gas line; and a flange on each collection housing that is rotatable up to about 180° at the exhaust gas inlet of the collecting housing when the exhaust gas outlet of the internal combustion engine is at outwardly facing sides of the cylinder heads.

* * * * *